United States Patent [19]

Woodle

[11] 4,257,470

[45] Mar. 24, 1981

[54] WAND CONSTRUCTION FOR VERTICAL VENETIAN BLINDS

[75] Inventor: Allan S. Woodle, Mamaroneck, N.Y.

[73] Assignee: Thru-Vu Vertical Blind Corp., Namaroneck, N.Y.

[21] Appl. No.: 53,320

[22] Filed: Jun. 29, 1979

[51] Int. Cl.[3] ..... E06B 9/30; E06B 9/26

[52] U.S. Cl. ..... 160/172; 160/176 R

[58] Field of Search ..... 160/166–178

[56] References Cited

U.S. PATENT DOCUMENTS

| | | | |
|---|---|---|---|
| 3,028,910 | 4/1962 | Bopp et al. | 160/177 |
| 3,194,366 | 7/1965 | Hensel | 160/173 |
| 3,455,364 | 7/1969 | Fukuoka | 160/176 |
| 3,828,838 | 8/1974 | Anderle et al. | 160/176 |
| 3,860,056 | 1/1975 | Bruneau | 160/176 |

*Primary Examiner*—Peter M. Caun

*Attorney, Agent, or Firm*—Charles E. Temko

[57] ABSTRACT

A rotary wand construction for use with vertical slat Venetian blinds, the vanes of which pivot about a vertical axis under the influence of a horizontally oriented ball chain which engages individual vane elements and passes about a vertically positioned rotating shaft at one end of the blind header. The shaft supports a pivotal joint supporting the upper end of the wand, and includes a slipping clutch preventing damage to the blind structure in the event an obstruction is met or the wand is rotated in either direction past the permissible limit of travel of the ball chain.

4 Claims, 5 Drawing Figures

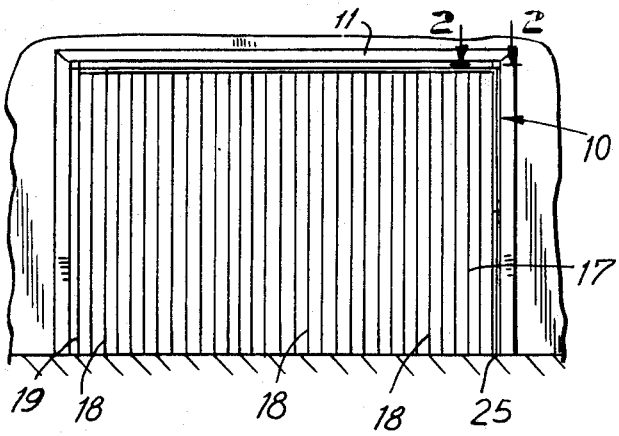
FIG. 1
FIG. 2
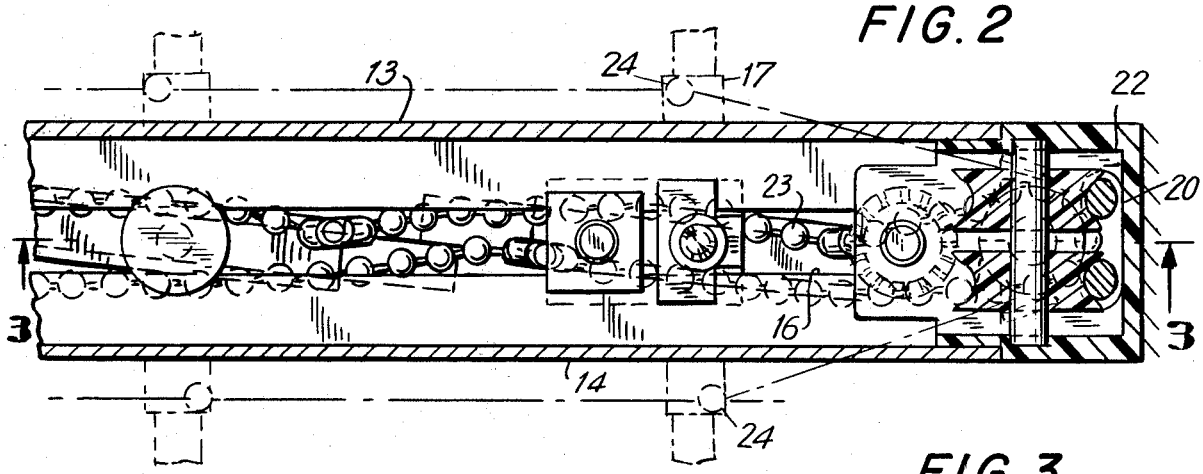
FIG. 3
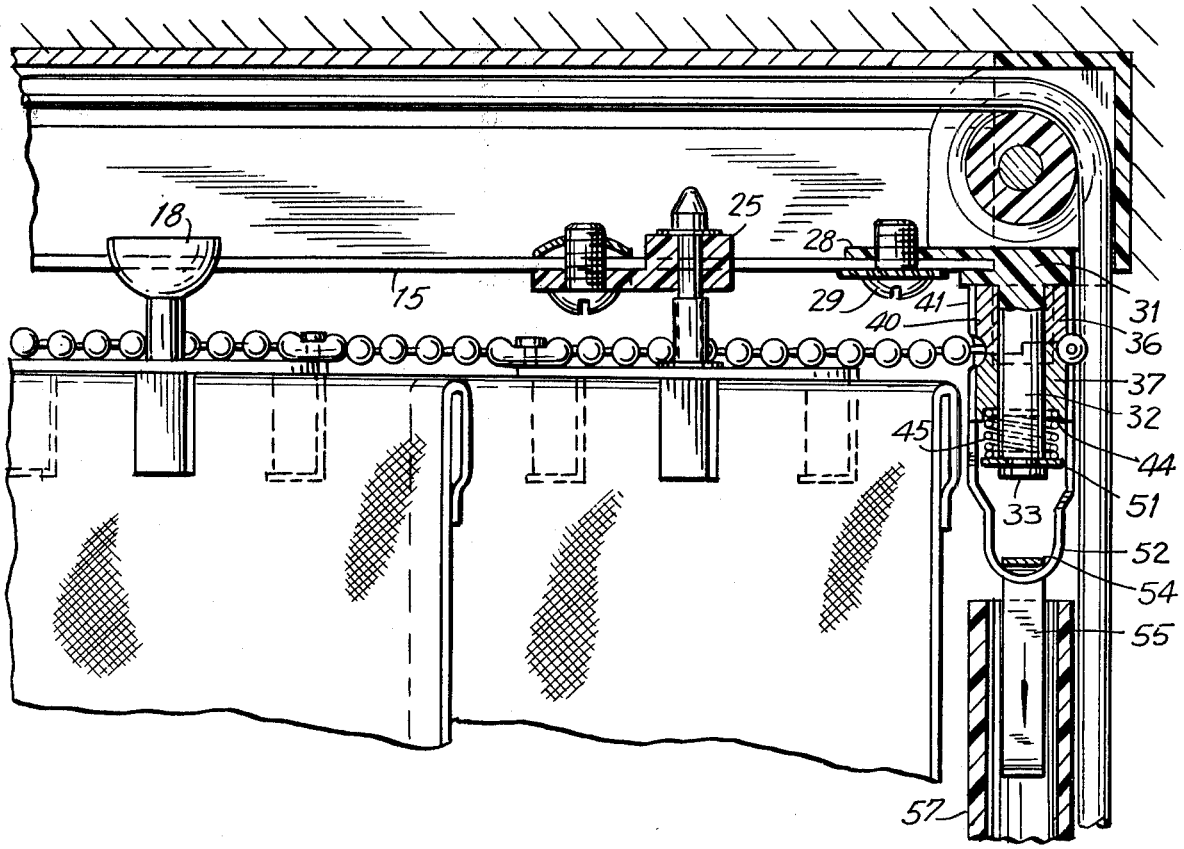

WAND CONSTRUCTION FOR VERTICAL VENETIAN BLINDS

BACKGROUND OF THE INVENTION

This invention relates generally to the field of vertical Venetian blinds, and more particularly to an improved means for simultaneously rotating the vane elements thereof about the principal axes of the vanes when they are in relatively extended position at spaced substantially equal intervals along a supporting header element.

The use of a manually engageable elongated wand supported at an upper end thereof by the header element is well known in the horizontal type Venetian blind art, where the construction involves the use of a universal joint or equivalent means to transmit rotational movement imparted to the wand about a vertical axis to one about a horizontal axis. Because the horizontal type blind employs cords which pass over pulleys, the tendency of the cords to slip under excessive tension provides a built-in safety factor preventing damage to the blind components under misuse.

The provision of equivalent structure in a vertical type blind is somewhat more involved, since ball or bead chains, in order to transmit motion from a shaft, must entrain pulleys which are provided with indentations or recesses which correspond in size and spacing to the diameter of the individual balls or beads comprising the chain. Once engaged with such a pulley, slipping does not readily occur, and when excessive rotation of the wand occurs, damage to delicate parts of the blind normally results.

The provision of a friction clutch means in the motion train is an expedient readily occurring to a worker skilled in the art, but existing clutch structure known in other arts is relatively expensive to manufacture, and cannot readily be incorporated into a vertical blind header. The desirability of wand type adjustment means is well established by the convenience obtained in use, and that fact that the relatively rigid wand, when released by the user automatically returns out of the way beneath the header, so that it does not detract from the decorative appearance of the blind.

SUMMARY OF THE INVENTION

Briefly stated, the invention contemplates the provision of a vertical type Venetian blind of an improved wand construction for rotating the individual vane elements thereof about the individual respective axes thereof. The novel structure includes a supporting element which forms an end cap on the blind header, the supporting element having a shaft depending therefrom supporting a pair of pulley elements incorporating clutch means. A compression spring having a principal axis coincident with that of the shaft presses the pulley elements together to entrain a segment of ball chain transmitting motion to the vein elements. One of the pulley elements is provided with a loop pivotally engaging corresponding means on an upper end of the wand for the transmission of rotational motion therethrough. Upon the occurrence of excessive torque, the pulley element contacting the spring separates from the other pulley element against the compressive force of the spring and permits slipping of said one of said pulley elements relative to the other.

BRIEF DESCRIPTION OF THE DRAWING

In the drawing, to which reference will be made in the specification, similar reference characters have been employed to designate corresponding parts throughout the several views.

FIG. 1 is a fragmentary view in elevation of an embodiment of the invention in installed condition within a window opening.

FIG. 2 is an enlarged fragmentary horizontal sectional view as seen from the plane 2—2 in FIG. 1.

FIG. 3 is an enlarged fragmentary vertical sectional view as seen from the plane 3—3 in FIG. 2.

DETAILED DESCRIPTION OF THE DISCLOSED EMBODIMENT

Figure 5:
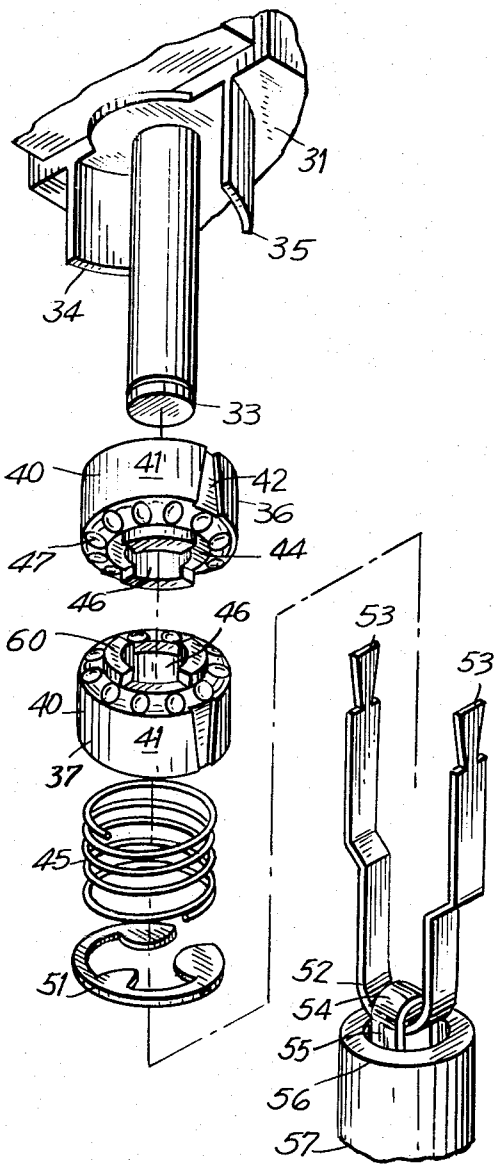
FIG. 5 is an exploded view in perspective corresponding to the righthand portion of FIG. 3.
Figure 4:
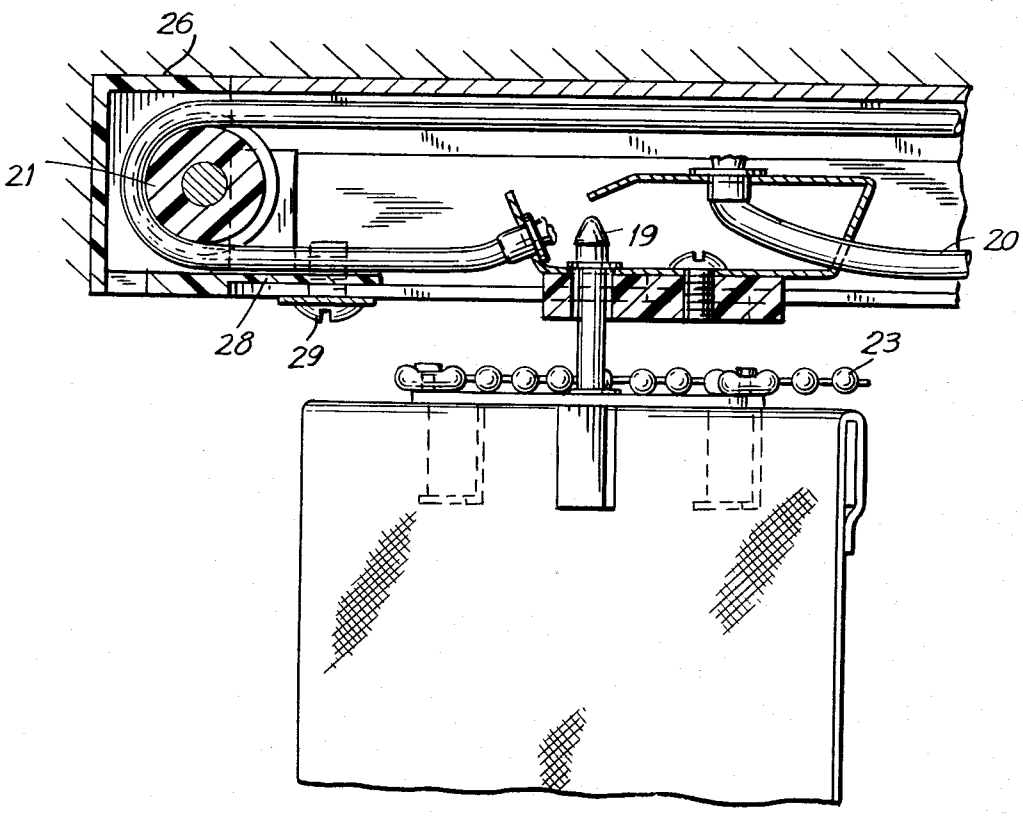
FIG. 4 is an enlarged vertical sectional view corresponding to that seen in FIG. 3, but showing an opposite end of the device.

In accordance with the invention, the device, generally indicated by reference character 10, includes a header element 11 of elongated rectangular cross-section, the details of which are known in the art, and need not be further considered herein. The element 11 is preferably formed as a metallic extrusion, and includes an upper wall 12, side walls 13 and 14, and a lower wall 15 having an elongated slot 16 forming a track. Fixed within the track is a first vane element 17, a plurality of longitudinally slidable vane elements 18 and a leftwardmost element 19 anchored to a segment of cord means 20. The cord means passes over a leftward pulley element 21 and a rightward element 22 to be held in tensed condition by a weight 25, not shown. A ball chain 23 is provided with plural connecting means 24 for engaging each of the vane elements at two mutually spaced points for the purpose of imparting rotational motion thereto. The lefthand pulley element 21 is incorporated in and into an end cap 26, and the righthand pulley element 22 is incorporated into a corresponding end cap 27, both caps being conveniently moldable from nylon or other suitable material. Each includes a track engaging extensions 28 and is fixed in position by a bolt and lock nut 29. Molded integrally with and extending downwardly from a lower wall 31 of the cap 27 is a short shaft 32, the lower end 33 of which is provided with a removable enlargement. Depending parallel to the shaft 32 are first and second guide members 34 and 35, which, as will more fully appear, serve to maintain the ball chain 23 in entrained condition.

Carried by the shaft for rotation thereon are first and second oppositely disposed pulley members 36 and 37, respectively, which are most conveniently formed by molding employing well known powder metallurgy techniques. Each includes a cylindrical body 40 bounded by an outer cylindrical surface 41 having dovetailed notches 42, an outer end surface 43, and a recess 44 for the accommodation of a coil spring 45. The dimensions of a centrally disposed bore 46 closely correspond to the diameter of the shaft 32 so as to turn freely thereon. The coil spring 45 is anchored at one end by a spring clip 33. The opposite end engages the recess 44 in the member 37 to urge the members 36 and 37 together. The opposite end surfaces 47 are configured to include a plurality of spherical recesses corresponding in radius to that of the balls comprising the chain 23.

The spring clip 33 engages the lower end of the shaft 32 and maintains the above-described structure in assembled condition. A U-shaped clip 52 is provided with dovetail-shaped ends 53 which engages the notches 42 in the surface 41 of member 36. The center portion 54 thereof engages a hook member 55 carried by the upper end of a hollow wand 57 to provide a flexible interconnecting joint enabling the wand to be rotated about its own axis while disposed at a substantial angle with respect to the vertical.

The adjustment of the blind by use of the wand will be apparent from a consideration of the drawing. Should an obstruction preventing rotation of the vanes, or should rotation of the wand be inadvertently continued after the wand has rotated to maximum pivotal excursion, tension will build up in the ball chain. This is relieved by the camming action exerted by the chain on the second pulley member 37 which deflects the spring 48 to a degree permitting it to slip relative to the chain until excessive torque has been relieved. During this movement, the chain remains relatively motionless, and after an increment of rotation corresponding spacing of interlocking projections 59 and 60, a distinct click will be heard, and a detenting movement sensed by the user, warning him not to continue further rotation in the same direction. Should he persist, the same disengaging action will recur.

I wish it to be understood that I do not consider the invention limited to the precise details of structure shown and set forth in this specification, for obvious modifications will occur to those skilled in the art to which the invention pertains.

I claim:

1. In a vertical type Venetian blind, including a header element forming a track supporting a plurality of depending vane elements for lateral translational movement within said track, and rotational movement about the principal axes of said vane elements, said vane elements being interconnected by a single ball chain at each of two spaced points on each vein element, improved means for communicating manually imparted movement by a user to said ball chain for rotating said vane elements, said means comprising: a vertically depending shaft supported by said header element, a pair of generally cylindrical pulley members rotatably positioned upon said shaft, each pulley member having a surface defining recesses corresponding to the shape of said ball chain, whereby when said surfaces are placed in juxtaposed relation, a single shaped curvilinear channel accommodating said chain is formed; resilient means carried by said shaft for urging said surfaces to said juxtaposed relation; a generally U-shaped clip having means thereon engaging said one of said pulley members, and a manually engageable elongated wand having means at an upper end thereof; pivotally engaging said clip means to form a flexible joint for the transmission of rotational motion therethrough; said one of said pulley members being axially shiftable along said shaft against said resilient means to permit slippage of said one of said pulley members relative to an entrained segment of said chain upon the occurrence of excessive transmitted torque to prevent damage to said blind.

2. The improvement in accordance with claim 1, further characterized in said clip element having first and second ends, each engaging a diametrically opposed point on said outer surface of said one of said pulley elements.

3. The improvement in accordance with claim 1, further characterized in said header element including a molded end cap, said shaft being formed integrally with said cap.

4. The improvement in accordance with claim 1, further characterized in said pulley members having interlocking projections on abutting surfaces thereof which are disengaged by relative axial movement of said pulley members.

* * * * *